United States Patent [19]

Hermanson

[11] 3,957,510

[45] May 18, 1976

[54] OVERFLOW PREVENTION FOR LIQUID BETWEEN FLEXIBLE LAYERS ON A SOLID SURFACE

[75] Inventor: Herman A. Hermanson, Penfield, N.Y.

[73] Assignee: Xerox Corporation, Stamford, Conn.

[22] Filed: Apr. 30, 1974

[21] Appl. No.: 465,644

[52] U.S. Cl. ..... 96/1 PE; 355/3 P; 204/181; 118/637; 118/638

[51] Int. Cl.[2] ..... G03G 17/04

[58] Field of Search ..... 96/1 PE, 76 C, 29 R, 96/1 R; 204/299 PE, 300 PE, 181 PE; 118/637, 638; 355/3 PE

[56] References Cited

UNITED STATES PATENTS

| | | | |
|---|---|---|---|
| 2,686,716 | 8/1954 | Land | 96/78 |
| 3,647,441 | 3/1972 | Bachelder | 96/29 R |
| 3,652,281 | 3/1972 | Bachelder et al. | 96/76 C |
| 3,702,289 | 11/1972 | Egnaczak | 96/1 PE |
| 3,764,332 | 10/1973 | Harvey | 96/76 C |
| 3,830,199 | 8/1974 | Saito et al. | 117/37 LE |

*Primary Examiner*—David Klein
*Assistant Examiner*—Judson R. Hightower
*Attorney, Agent, or Firm*—James J. Ralabate; Michael H. Shanahan; Charles E. Smith

[57] ABSTRACT

Method and apparatus for preventing the overflow of liquid from between flexible layers on a solid surface. A groove is provided in the solid surface at a location not beyond the edge of at least the bottom flexible layer and preferably not beyond the edge of both flexible layers, to reduce, at the groove, the mechanical pressure (and optionally electrical pressure) forcing the flexible layers together to permit a liquid bead to form at layer portions adjacent the groove instead of having the liquid squeezed out and off the edge of both flexible layers.

In a preferred embodiment, this system is used in photoelectrophoretic imaging using photoelectrophoretic suspension between webs having an electrical field thereacross, on a grooved curved surface, preferably a roller. The suspension is prevented from dripping out the edges of the webs which, inter alia, prevents the ink from seeping back along the web/roller interface which may adversely effect imaging.

16 Claims, 1 Drawing Figure

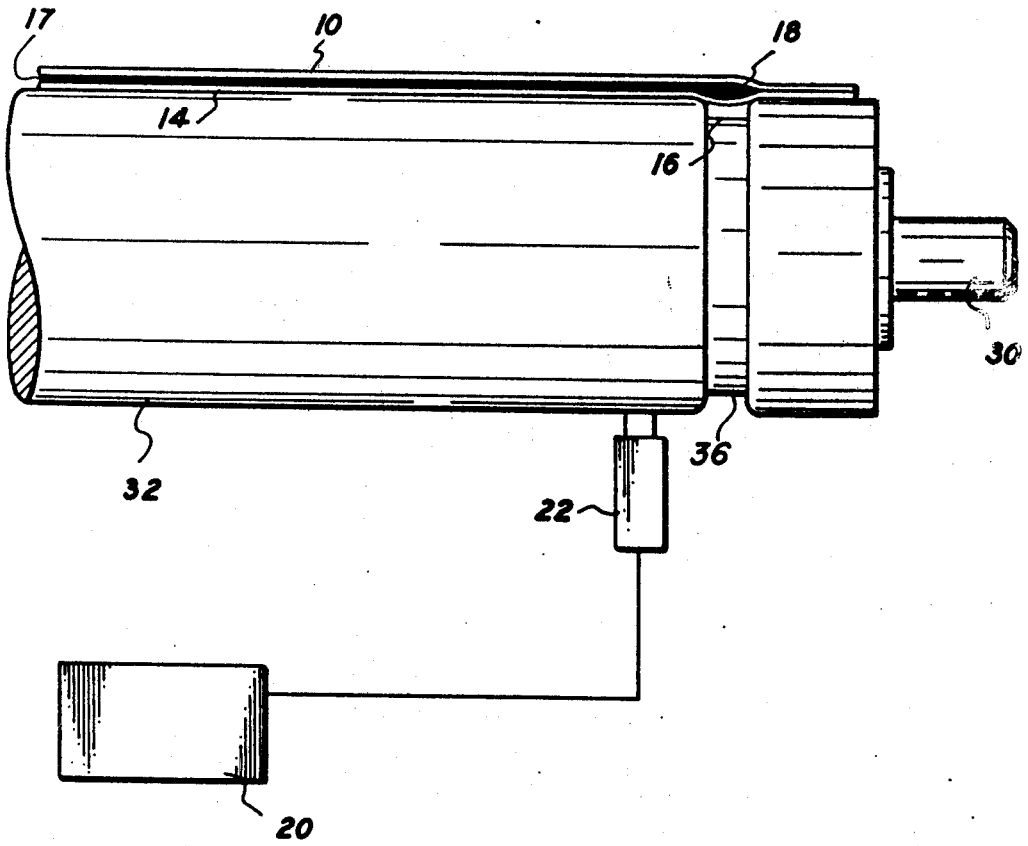
17
10
18
14
16
30
32
36
22
20

OVERFLOW PREVENTION FOR LIQUID BETWEEN FLEXIBLE LAYERS ON A SOLID SURFACE

BACKGROUND OF THE INVENTION

This invention relates in general to method and apparatus for preventing the overflow of liquid from between flexible layers on a solid surface and, more particulary, their use in an improved photoelectrophoretic web imaging device.

In the photoelectrophoretic imaging process, monochromatic including black and white or full color images are formed through the use of photoelectrophoresis. An extensive and detailed description of the photoelectrophoretic process is found in U.S. Pat. Nos. 3,384,488 and 3,384,565 to Tulagin and Carreira; 3,383,993 to Yeh and 3,384,566 to Clark, which disclose a system where photoelectrophoretic particles migrate in image configuration providing a visual image at one or both of two electrodes between which the particles suspended within an insulating carrier is placed. The particles are electrically photosensitive and are believed to bear a net electrical charge while suspended which causes them to be attracted to one electrode and apparently undergo a net change in polarity upon exposure to activating electromagnetic radiation. The particles will migrate from one of the electrodes under the influence of an electric field through the liquid carrier to the other electrode.

The photoelectrophoretic imaging process is either monochromatic or polychromatic depending upon whether the photosensitive particles within the liquid carrier are responsive to the same or different portions of the light spectrum. A full-color polychromatic system is obtained, for example, by using cyan, magenta and yellow colored particles which are responsive to red, green and blue light respectively.

In photoelectrophoretic imaging generally, and as employed in the instant invention, the important broad teachings in the following four paragraphs should be noted.

Preferably, as taught in the four patents referred to above, the electric field across the imaging suspension is applied between electrodes having certain preferred properties, i.e., an injecting electrode and a blocking electrode, and the exposure to activating radiation occurs simultaneously with field application. However, as taught in various of the four patents referred to above and Luebbe et al., U.S. Pat. No. 3,595,770; Keller et al., U.S. Pat. No. 3,647,659 and Carreira et al., U.S. Pat. No. 3,477,934; such a wide variety of materials and modes for associating an electrical bias therewith, e.g., charged insulating webs, may serve as the electrodes, i.e., the means for applying the electric field across the imaging suspension, that opposed electrodes generally can be used; and that exposure and electric field applying steps may be sequential. In preferred embodiments herein, one electrode may be referred to as the injecting electrode and the opposite electrode as the blocking electrode. This is a preferred embodiment description. The terms blocking electrode and injecting electrode should be understood and interpreted in the context of the above comments throughout the specification and claims hereof.

It should also be noted that any suitable electrically photosensitive particle may be used. Kaprelian, U.S. Pat. No. 2,940,847 and Yeh, U.S. Pat. No. 3,681,064 disclose various electrically photosensitive particles, as do the four patents referred to above.

In a preferred mode, at least one of the electrodes is transparent, which also encompasses partial transparency that is sufficient to pass enough electromagnetic radiation to cause photoelectrophoretic imaging. However, as described in Weigh, U.S. Pat. No. 3,616,390 both electrodes may be opaque.

Preferably, the injecting electrode is grounded and the blocking electrode is biased to provide the field for imaging. However, such a wide variety of variations in how the field may be applied can be used, including grounding the blocking electrode and biasing the injecting electrode, biasing both electrodes with different bias values of the same polarity, biasing one electrode at one polarity and biasing the other at an opposite polarity of the same or different value, that just applying sufficient field for imaging can be used.

The photoelectrophoretic imaging system disclosed in the above-identified patents may utilize a wide variety of electrode configurations including a transparent flat electrode configuration for one of the electrodes, a flat plate or roller for the other electrode used in establishing the electric field across the imaging suspension.

There has been recently developed a photoelectrophoretic imaging system which utilizes web materials, which optimally may be disposable. In this process, the desired, e.g., positive image, is formed on one of the webs and another web will carry away the negative or unwanted image. The positive image can be fixed to the web upon which it is formed, or the image transferred to a suitable backing such as paper. The web which carries the negative image can be rewound and later disposed of. In such photoelectrophoretic imaging systems employing disposable webs, cleaning systems are not required.

In a photoelectrophoretic web imaging device, an about 1 mil coating of imaging suspension may be coated on the conductive or injecting web and brought into contact with a second web, referred to as a blocking web, to form an ink-web sandwich at the imaging zone whereat, the ink is subjected to an electrical field and image exposure. When the electrical field is applied across the ink-web sandwich, there is a tendency for suspension to be uniformly squeezed out from between the webs to the side edges of the webs. If this overflow is not curtailed or prevented, this overflow liquid transfers to the imaging roller and in turn starts to work its way back between the roller and web and may thereby degrade the quality of images produced.

Apparatus in which liquid trapping systems are generally disclosed, British Patent Publication 1,326,786, published Aug. 15, 1973, discloses electrophoretic apparatus for preventing liquid overflow. In the British device, a drum which supports a photosensitive member is provided with annular grooves along the outside edges of the drum and outside the edges of the photosensitive member. In applicant's device, annular grooves are provided on the roller inside the edges of the two support members.

Overflow prevention devices are also found in the camera art. For example, E. H. Land, U.S. Pat. No. 2,627,460, issued Feb. 3, 1953, shows a trap for the reception and holding of excess liquid composition used for development of the film in the Land camera; Land, U.S. Pat. No. 2,686,716, issued Aug. 17, 1954, discloses a liquid trapping device in a camera film unit which collects excess liquid after the main portion of the liquid is spread between two liquid containing layers by rupturing a container between pressure rollers. A collar having a height on the order of the thickness desired for the layer of liquid to cover the image area is provided on each end of the rollers to prevent the spreading of liquid into other parts of the camera. Other techniques to prevent the overflow of liquid in the photographic art are found in U.S. Pat. Nos. 2,627,470; 2,868,717; 2,689,243 and 3,320,065. The device of applicant's invention is a simple and improved system to prevent the overflow of liquid from between flexible layers on a solid surface and for application in photoelectrophoretic web devices.

SUMMARY OF THE INVENTION

Accordingly, it is the object of the present invention to provide an overflow prevention system for liquid between flexible layers on a solid surface.

Another object of this invention is to improve photoelectrophoretic imaging systems employing a photoelectrophoretic suspension between webs by eliminating image defects caused by liquid from being forced out from between the webs.

The foregoing objects and others are accomplished in accordance with this invention by the method and apparatus for preventing the overflow of liquid from between flexible layers on a solid surface. A groove is provided in the solid surface at a location not beyond the edge of at least the bottom flexible layer, and preferably, not beyond the edge of both flexible layers, to reduce, at the groove, the mechanical pressure (and optionally electrical pressure) forcing the flexible layers together to permit a liquid bead to form at layer portions adjacent the groove, instead of having the liquid squeezed out and off the edge of both flexible layers.

In a preferred embodiment, this system is used in photoelectrophoretic imaging using photoelectrophoretic suspension between webs having an electrical field thereacross, on a grooved curved surface, preferably a roller. The suspension is prevented from dripping out the edges of the webs which, inter alia, prevents the ink from seeping back along the web/roller interface which may adversely effect imaging.

These and other objects and advantages of this liquid overflow prevention system will become apparent to those skilled in the art after reading the following detailed description taken in conjunction with the accompanying drawing wherein there is shown a side view, schematic drawing of a portion of a photoelectrophoretic imaging apparatus employing the preferred embodiment of this invention.

DESCRIPTION OF THE PREFERRED EMBODIMENT

The invention, herein, is described and illustrated in specific embodiments having specific components listed for carrying out the functions of the apparatus. Nevertheless, the invention need not be thought of as being confined to such specific showings and should be construed broadly within the scope of the claims. Any and all equivalent structures and methods known by those skilled in the art can be substituted for the specific apparatus and methods disclosed as long as the substituted method and apparatus achieve a similar function. It may be that systems other than photoelectrophoretic imaging systems have been or will be invented wherein the methods and apparatus described and claimed herein can be advantageously employed and such other uses are intended to be encompassed in this invention as described and claimed herein.

Referring to the FIGURE, there is shown a portion of a web configuration photoelectrophoretic imaging system illustrating a preferred mode of this invention. The web 10, referred to as the injecting web, is formed of an about 1 mil Mylar, a polyethylene terephthalate polyester film from DuPont, overcoated with a thin transparent conductive material, e.g., about 50% white light transmissive layer of aluminum. The conductive side of the injecting web contacting the suspension 17 is electrically grounded at a convenient location within the system (not shown). A metered flow of ink or imaging suspension 17 of the desired thickness is supplied on the conductive side of the injecting web 10. The web 14 is called the blocking web, and is formed of about 1 mil clear polypropylene backing material. The blocking web 14 travels in a path in intimate engagement with the imaging roller 32. The blocking web 14 and the injecting web 10 are brought together at the imaging roller 32 supported for rotation on the shaft 30 to form the ink-web sandwich. Although, in this exemplary example, the webs 10 and 14 are rewindable disposable webs, one or both may also be a reusable endless belt electrode.

When the two webs are brought together at the imaging roller 32 to form the ink-web sandwich, the imaging roller 32, which may be formed of steel or conductive rubber, may be utilized to apply a uniform electrical imaging field across the ink-web sandwich from the voltage source 20 via brush 22. When the electrical field is applied across the ink-web sandwich, there is a tendency for liquid suspension to be uniformly squeezed out of the edges of the webs. If this overflow is not curtailed, after some time, liquid (mineral oil/ink combination) eventually is transferred to the imaging roller 32 and consequently works its way back between the roller and web 14 and may result in imaging defects. In order to eliminate this problem, the imaging roller 32 is provided with annular grooves 16 on the peripheral surface near the side edges of the imaging roller 32 but not beyond the edges of the blocking web 14 location on the roller. In one example, the grooves 16 are approximately ⅛ inch deep and ⅛ inch wide. All corners are beveled or rounded to eliminate possible high electrical field points. The function of the grooves 16 is twofold. One function is to drop the pressure, both electrical and mechanical, at a point in the web near the side of the web. When these forces are exerted on the ink-web sandwich this, in turn, produces a liquid bead 18 near the edge of the web which forms within the recesses of the grooves rather than being squeezed out completely. Another function of the groove 16 is to create an obstacle on the imaging roller surface which is underneath the web 14 to prevent the liquid 17 from seeping back along the web/roller interface. When the forces are applied, these web portions above the grooves 16 tend to be filled with liquid and the bulge within the groove acts as a seal, preventing liquid from overflowing out of the edges of the webs and working back between the roller 32 and web 14. The mechanical pressure, referred to herein, includes the weight of the flexible layers, which in the preferred mode are webs, and the electrostatic force the webs exert upon one another, and may also include those forces resulting from the layers being entrained to wrap around the solid surface or roller by guide means.

While much of the above discussion is directed to overflow prevention at the imaging zone and imaging roller 32, it will be appreciated that the invention hereof can also be used at the transfer zone where the photoelectrophoretic image formed during imaging, is transferred to a final imaging support surface. At the transfer zone there may be carrier liquid and/or other liquid associated with and covering the photoelectrophoretic image before transfer.

Other modifications of the above described invention will become apparent to those skilled in the art and are intended to be incorporated herein.

What is claimed is:

1. Apparatus for preventing the overflow of liquid from between flexible layers on a support surface comprising in combination:

a. first and second discrete, flexible layers having a layer of liquid sandwiched therebetween;

b. a support surface contacting said first layer and supporting said first layer; said support surface having at least one groove not beyond the adjacent edges of at least said first layer in contact with said support surface, the dimensions of the groove being sufficiently greater than the thickness of said first layer that said layer may flex at least part way into the groove; and c. means for exerting pressure across the sandwich at said support surface; whereby excess liquid, if any, can depress said first layer at the groove at least part way into the groove creating at the groove a depression for collecting a bead of the liquid.

2. Apparatus according to claim 1 wherein said support surface is a roller having a groove on each end of said roller surface at locations not beyond the edges of said flexible layers.

3. Apparatus according to claim 2 wherein said flexible layers are webs.

4. Apparatus according to claim 3 wherein said pressures include both electrical and mechanical pressure.

5. Apparatus according to claim 4 wherein both of said webs are reusable.

6. Apparatus according to claim 5 wherein said liquid comprises an imaging suspension of electrically photosensitive particles in a carrier liquid.

7. Apparatus according to claim 6 wherein said roller is an imaging roller for applying an imaging voltage which causes the electrical pressure across the sandwich and further including means for exposing the suspension at the sandwich to an image of activating radiation.

8. Apparatus according to claim 7 wherein at least one of said webs is transparent and wherein said imagewise exposure is through said transparent web.

9. A method for preventing the overflow of liquid from between flexible layers on a support surface comprising:

a. providing at least two discrete, flexible layers with a layer of liquid sandwiched therebetween, said support surface having at least one groove not beyond the edge of at least the layer in contact with the support surface, the dimensions of the groove being sufficiently greater than the thickness of said layer in contact with the support surface that said layer may flex at least part way into the groove;

b. causing relative movement between the layers and the support surface; and c. exerting pressure across the sandwich at the support surface; whereby excess liquid, if any, can depress said surface layer at the groove at least part way into the groove creating at the groove a depression for collecting a bead of the liquid.

10. A method according to claim 9 wherein said support surface is a roller having a groove on each end of said roller surface at locations beyond the edges of said layers.

11. A method according to claim 10 wherein said flexible layers are webs.

12. A method according to claim 11 wherein said pressures include both electrical and mechanical pressure.

13. A method according to claim 12 wherein both of said webs are reusable.

14. A method according to claim 12 wherein said liquid comprises an imaging suspension of electrically photosensitive particles in a carrier liquid.

15. A method according to claim 14 wherein said roller is an imaging roller and further including exposing the suspension at the sandwich to an image of activating radiation.

16. A method according to claim 9 wherein said support surface is a roller having a groove on at least one end of said roller at a location not beyond the edges of said flexible layers.

* * * * *